US008201909B2

(12) United States Patent
Barbour et al.

(10) Patent No.: US 8,201,909 B2
(45) Date of Patent: Jun. 19, 2012

(54) INKJET PRINTING SYSTEM AND METHOD

(75) Inventors: Mike Barbour, Corvallis, OR (US); Mark R. Thackray, Corvallis, OR (US); Charles W. Gilson, Philomath, OR (US)

(73) Assignee: Videojet Technologies Inc., Wood Dale, IL (US)

( * ) Notice: Subject to any disclaimer, the term of this patent is extended or adjusted under 35 U.S.C. 154(b) by 441 days.

(21) Appl. No.: 12/629,995

(22) Filed: Dec. 3, 2009

(65) Prior Publication Data

US 2010/0134549 A1 Jun. 3, 2010

Related U.S. Application Data

(60) Provisional application No. 61/119,520, filed on Dec. 3, 2008.

(51) Int. Cl.

| | |
|---|---|
| ***B41J 29/38*** | (2006.01) |
| ***B41J 2/15*** | (2006.01) |
| ***B41J 2/145*** | (2006.01) |
| ***B41J 2/155*** | (2006.01) |

(52) U.S. Cl. ..... 347/14; 347/40; 347/41; 347/42

(58) Field of Classification Search ..... 347/14, 347/42

See application file for complete search history.

(56) References Cited

U.S. PATENT DOCUMENTS

| | | | |
|---|---|---|---|
| 3,977,007 | A | 8/1976 | Berry et al. |
| 4,216,480 | A | 8/1980 | Buehner et al. |
| 4,748,453 | A | 5/1988 | Lin et al. |
| 4,881,069 | A | 11/1989 | Kameda et al. |
| 5,059,984 | A | 10/1991 | Moore et al. |
| 5,079,571 | A | 1/1992 | Eriksen |
| 5,155,503 | A | 10/1992 | Tasaki et al. |
| 5,270,728 | A | 12/1993 | Lund et al. |
| 5,353,387 | A | 10/1994 | Petschik et al. |
| 5,359,355 | A | 10/1994 | Nagoshi et al. |
| 5,535,308 | A | 7/1996 | Hayashi et al. |
| 5,600,351 | A | 2/1997 | Holstun et al. |
| 5,675,370 | A | 10/1997 | Austin et al. |
| 5,742,300 | A | 4/1998 | Klassen |
| 5,790,150 | A | 8/1998 | Lidke et al. |
| 5,796,416 | A | 8/1998 | Silverbrook |
| 5,831,642 | A | 11/1998 | Matsubara et al. |
| 5,847,723 | A | 12/1998 | Akahira et al. |
| 5,984,455 | A | 11/1999 | Anderson |
| 6,025,861 | A | 2/2000 | Austin et al. |
| 6,109,739 | A | 8/2000 | Stamer et al. |
| 6,175,376 | B1 | 1/2001 | Austin et al. |
| 6,179,407 | B1 | 1/2001 | Bockman |
| 6,336,702 | B1 | 1/2002 | Zapata et al. |
| 6,382,768 | B1 | 5/2002 | Koitabashi et al. |
| 6,485,125 | B2 | 11/2002 | Fujioka et al. |
| 6,508,535 | B1 | 1/2003 | Klassen |
| 6,508,537 | B2 | 1/2003 | Yamada et al. |
| 6,530,645 | B2 | 3/2003 | Haflinger |
| 6,680,784 | B1 | 1/2004 | Nomura et al. |

(Continued)

*Primary Examiner* — Uyen Chau N Le
*Assistant Examiner* — Kajli Prince
(74) *Attorney, Agent, or Firm* — Beusse Wolter Sanks Mora & Maire, P.A.

(57) ABSTRACT

An inkjet printing system and method for printing comprising a printhead having two columns of nozzles, and the printhead is in fluid communication with an ink source and in electrical communication with a controller. In response to the print control signals transmitted from the controller, the printhead ejects ink from the two columns in alternating succession to print images having a checkerboard pattern.

20 Claims, 9 Drawing Sheets

U.S. PATENT DOCUMENTS

| | | | | |
|---|---|---|---|---|
| 6,695,426 | B2 | 2/2004 | Herwald et al. | |
| 6,764,162 | B2 | 7/2004 | Biddle et al. | |
| 6,832,823 | B1 | 12/2004 | Askeland et al. | |
| 6,834,936 | B2 | 12/2004 | Teshigawara et al. | |
| 7,032,991 | B1 | 4/2006 | Otsuka et al. | |
| 7,048,355 | B2 * | 5/2006 | Torgerson et al. | 347/40 |
| 7,059,698 | B1 | 6/2006 | Marra, III et al. | |
| 7,070,346 | B2 | 7/2006 | Fujimori | |
| 7,296,877 | B2 | 11/2007 | Chikuma et al. | |
| 7,407,249 | B2 | 8/2008 | Jeong | |
| 2005/0253897 | A1 | 11/2005 | Silverbrook | |
| 2007/0085889 | A1 | 4/2007 | Cardells et al. | |
| 2007/0091136 | A1 | 4/2007 | Barkley et al. | |
| 2008/0001982 | A1 | 1/2008 | Schulmeister | |

* cited by examiner

INKJET PRINTING SYSTEM AND METHOD

CROSS-REFERENCE TO RELATED APPLICATIONS

This application claims the benefit of U.S. Provisional Application No. 61/119,520 filed Dec. 3, 2008, and incorporated herein by reference in its entirety.

BACKGROUND OF THE INVENTION

Embodiments of the invention relate to inkjet printing systems and methods. More specifically, the invention pertains to inkjet printing systems and methods that incorporate dot-matrix fonts to form images on a print medium. In addition, embodiments of the invention also relate to thermal inkjet printing systems that utilize the dot matrix font.

Dot matrix font or formatting is a fundamental component for inkjet printing systems. Inkjet printheads include an array of orifices (also referred to as "nozzles") on the printhead wherein each nozzle is associated with an ink ejection chamber. Ink is ejected from the nozzles and chambers in droplet form onto a print medium in response to print commands generated by a controller. In thermal inkjet printing systems resistive heaters at the ejection chambers heat the ink in the chamber causing the ink to vaporize forming rapidly expanding pressure bubbles that force the ink drops from the chamber. The piezo-type printheads use mechanically vibrating piezo-transducers to eject the ink drops from the chambers and nozzles. In either type, the printhead may be mounted on a carriage that moves the printhead back and forth on an X-axis relative to a print medium, which is moving in a Y-axis direction relative to the printhead. In other inkjet printing systems, the printhead may remain stationary relative to movement of the print medium.

Images or characters are formed on the print medium by ejecting the ink drops according to an arrangement of dots in a dot matrix consisting of rows and columns of pixels. Each pixel represents a potential ink drop or dot. The arrangement of the dots relative to one another on the dot matrix dictates which nozzles eject ink to form an image, and the timing of the ejections. The quality of an image printed depends in part on the resolution capabilities of the printing system. Resolution is measured as the number of ink drops that can be printed in one linear inch. A typical desk top inkjet printer has resolution capabilities of three hundred dots per inch (300 dpi). In order to increase resolution, the dot size (consequently nozzle size) may be decreased. In addition, the ejection frequency for a nozzle (number of times a nozzle is fired for a given time interval) may be increased to fit more dots within a determined space. This allows for optimal dot overlap to minimize white spaces and jagged edges in a printed character.

With respect to single-pass printing, for example in production line printing, two factors constrain printable dot density. The maximum vertical dot density is limited by the physical spacing of the nozzles as arranged on the printhead. In addition, the maximum horizontal dot density is limited by the maximum frequency (drops/second) at which a nozzle can eject drops divided by the relative speed of the printhead or print medium. Higher speeds mean lower horizontal drops per inch.

A typical printhead nozzle arrangement includes at least two columns (first column and second column). The nozzles in each column are horizontally offset relative to one another; and, the first and second columns are vertically offset relative to one another. Print command signals are multiplexed such that, the columns eject ink simultaneously, and ink drops generated from the second column fill in gaps or spaces in an ink dot column generated by the first nozzle column. In addition, the rate at which the printhead and/or print medium move relative to one another and the frequency at which the nozzles are capable of firing determine a horizontal dot density. These factors provide a maximum dot overlap with a relatively high resolution, if the print medium or printhead are moving at a given rate of speed. However, if the rate of speed of the printhead or print medium is increased or too high relative to the printhead/nozzle maximum ink ejection frequency, the dot overlap and resolution is compromised.

BRIEF DESCRIPTION OF THE INVENTION

Embodiments of the invention include an inkjet printing system for optimizing print quality at print speeds that are greater than a given print speed associated with an ink drop ejection frequency for a printhead. The inkjet printing system may comprise a printhead in fluid communication with an ink source and in electrical communication with at least one controller. The printhead has at least a first column of a plurality of nozzles and a second column of a plurality of nozzles on the printhead for ejecting ink onto a print medium in droplet form. Each of the nozzles in the first column are spaced apart from one another, the nozzles in the second column are spaced apart from one another and each of the nozzles in the first column are vertically offset relative to the nozzles in the second column and do not share a horizontal axis with any of the nozzles in the second column.

At least one controller is configured to generate print control signals relative to the formation of an image on the print medium. Responsive to the print control signals ink from the first column of nozzles is ejected in alternating succession with the ejection of ink from the second column of nozzles wherein one or more images are printed on the print medium in a single pass of the print medium and the printhead relative to one another. In an embodiment, the inkjet printhead and print medium move relative to one another at an optimal print speed of x and the printhead is capable of ejecting ink in droplet form at a maximum frequency of f and the nozzles in both columns are fired simultaneously to achieve a maximum horizontal dot density in which the horizontal dot density matches a vertical dot density. In addition, the printhead is capable of firing the nozzles in alternating succession at print speeds greater than x, and up to about 2x, to optimize print quality at print speeds that may exceed the optimal print speed associated with the maximum firing frequency of the printhead, and produce an image in which the horizontal dot density matches the vertical dot density.

In embodiments described herein as a system or method, selected images are printed in a single pass of the print medium and printhead relative to one another. The image generated may include a checkerboard pattern that includes a plurality of ink dot columns printed by the first nozzle column that are spaced apart on the print medium forming gaps there between. The second nozzle columns form ink dot columns at the gaps between and the ink dot columns from the first nozzle column forming the checkerboard pattern. The printed image includes a dot matrix having a plurality of dot columns and dot rows that have equal dot densities.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained.

DETAILED DESCRIPTION OF THE INVENTION

Figure 1:
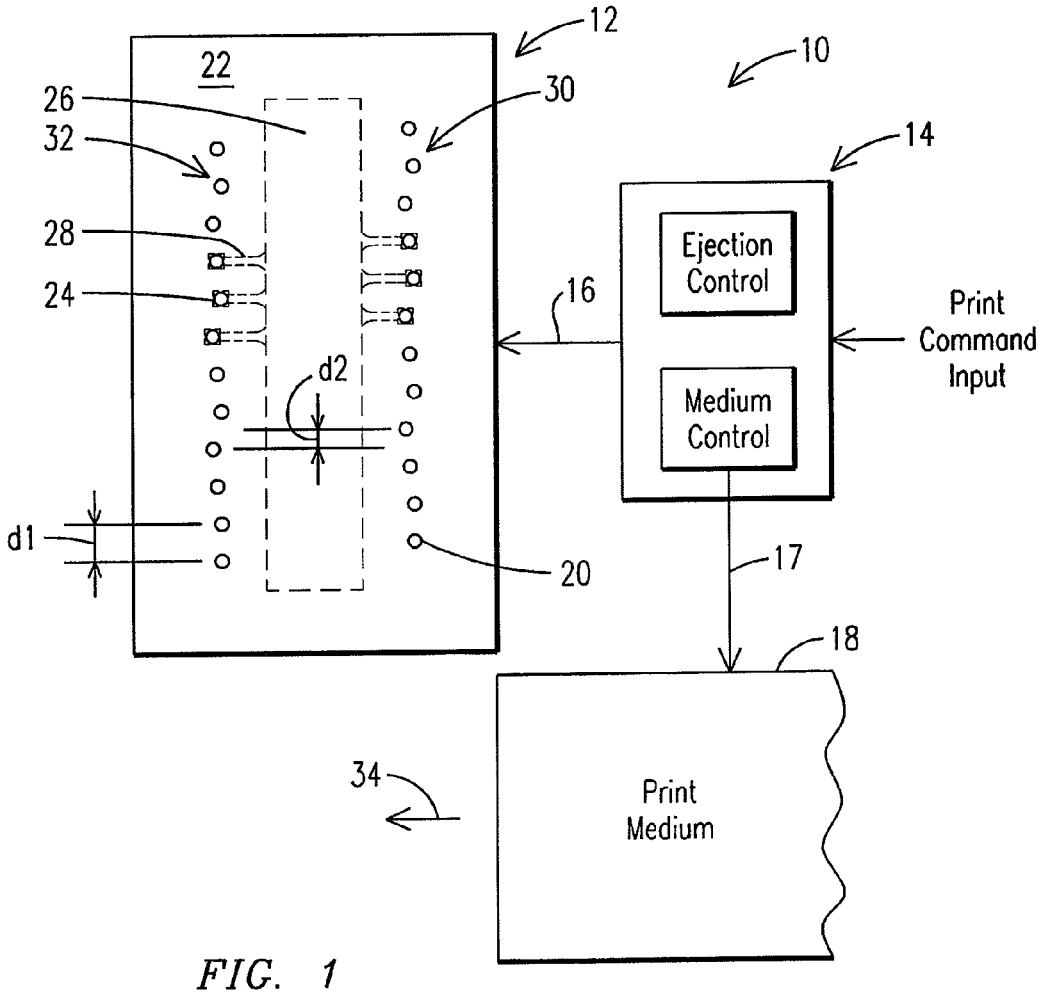
FIG. 1 is a schematic illustration of an inkjet printing system and printhead that may be used with the present invention.

Reference will now be made in detail to the embodiments consistent with the invention, examples of which are illustrated in the accompanying drawings. Wherever possible, the same reference numerals are used throughout the drawings and refer to the same or like parts. While the invention is described below in reference to a thermal inkjet printer, the invention is not so limited and may be incorporated into other inkjet printing systems that utilize other technologies, such as piezo-transducers to eject ink. The term "nozzle" as used herein shall mean the orifices formed in a printhead cover plate through which ink is ejected and/or shall also include such orifices and other components of the printhead such as an ejection chamber from which the ink is ejected. In addition, the described system and method for an inkjet printing system is not limited to application with a printhead assembly mounted to a cartridge housing, which may or may not be a disposable cartridge. The present invention may be used with printheads permanently mounted in printing systems and an ink supply is provided as necessary for printing. So the term cartridge may include a permanently mounted printhead only and/or the combination of the printhead with the ink source.

In addition, the term checkerboard font as used herein describes an alphanumeric image generated on a print medium and is provided by way of example only. The invention is intended to encompass checkerboard patterns for any images that may be printed on a print medium. Also, the term "maximum dot density" is intended to mean a dot density achieved in a printing operation whereby a horizontal dot density matches a vertical dot density at a given firing frequency and print speed wherein print speed is the rate of speed at which a printhead and print medium move relative to one another.

Before describing in detail the particular system and method for inkjet printing in accordance with the present invention, it should be observed that the present invention resides primarily in a novel combination of hardware and software elements related to said method and apparatus. Accordingly, the hardware and software elements have been represented by conventional elements in the drawings, showing only those specific details that are pertinent to the present invention, so as not to obscure the disclosure with structural details that will be readily apparent to those skilled in the art having the benefit of the description herein.

With respect to FIG. 1, there is schematically illustrated an inkjet printing system 10 including a printhead 12 in electrical communication with a controller 14 that transmits print control signals 16 to the printhead 12. In response to the print control signals 16, ink drops are ejected from the printhead 12 onto a print medium 18, which moves relative to the printhead 12. Alternatively, the printhead 12 may move relative to print medium 18, or both the printhead 12 and print medium 18 may move relative to one another.

The printhead 12 comprises an array of nozzles 20 formed thereon for ejecting ink in droplet form onto a print medium 18. The printhead 12 may be an integrated chip on which a nozzle plate 22 is affixed, and the nozzles 20 may be orifices having been formed in the nozzle plate 22 using fabrication techniques know to those skilled in the art. The chip portion of the printhead 12 includes a plurality of ink ejection chambers 24 wherein each chamber 24 is associated with a nozzle 20. The chambers 24 are in fluid communication with an ink source (not shown) via an ink slot 26 and channels 28. The printing system 10 also comprises a drive mechanism to eject ink from the chambers responsive to print commands. More specifically, the printhead 12 is placed in electrical communication with the controller 14, which, on command, transmits print control signals 16 and 17 to the printhead 12 and mechanisms to move the print medium 18, respectively. In the case of a thermal inkjet printer and in response to the print control signals 16, transistors (not shown) and resistive heaters (not shown) associated with the nozzles 20 are activated to generate ink drops ejected from the nozzles 20.

Embodiments of the invention may be used on inkjet printing systems that generate an image on a print medium in a single pass of the print medium 18 relative to the printhead 12, or vice versa. Examples of such printing systems are used in production line printing systems that print bar codes, dates or other information on product packaging that is moving past a stationary printhead. Two factors that may constrain a printable dot density in such single-pass printing systems comprise: (1) the maximum vertical dot density is limited by the physical spacing of the nozzles 20 on the printhead 12; and, (2) the maximum horizontal dot density is limited by the maximum frequency at which a nozzle 20 can eject drops (drops/second) divided by the relative speed of the printhead 12 and the medium 18, which shall be referred to as print speed measured in inches/second or feet/minute.

As shown in FIG. 1, the nozzles 20 are arranged in two columns 30 (first column) and 32 (second column) of offset nozzles 20, which is a typical arrangement of nozzles on inkjet printheads. More specifically, all the nozzles 20 in each of the columns 30 and 32 are spaced apart horizontally and vertically within a respective column 30 and 32. In addition, each of the nozzles 20 in the first column 30 is vertically offset relative to the nozzles 20 in the second column 32, and each such nozzle 20 in the first column 30 does not share a horizontal axis with a nozzle 20 in the second column 32. The terms "horizontal" and "vertical" are used to describe the positioning of the nozzles 20 in a single column and in both columns relative to one another. As shown in FIG. 1, the printhead 12 is oriented in such a manner that nozzle columns 30 and 32 are vertically offset so the nozzles in one column do not share a horizontal axis with any nozzle in the other column. Embodiments of the invention also comprise a printhead rotated ninety degrees, and the columns 30 and 32 are "horizontally" offset so that nozzles in one column do not share a vertical axis with any nozzle in the other column.

In an embodiment, the printhead nozzles 20 are arranged on the printhead 12 in such a manner to provide a dot matrix having a maximum dot density of 240 dpi×240 dpi at a print speed of 150 ft/min, wherein the horizontal dot density matches the vertical dot density. In a one half linear inch area centered on the printhead 12, each of the columns 30 and 32 includes sixty (60) nozzles 20. The nozzles 20 in each of the columns 30 and 32 may be vertically spaced apart from one another a distance d1 of 1/120". The nozzles 20 in column 30 are vertically offset a distance d2, or 1/240" relative to nozzles 20 in the second column 32 to achieve a vertical dot density of 240 dpi.

Figure 2:
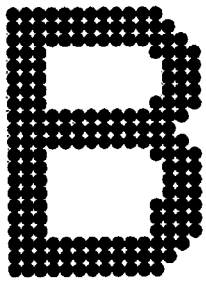
FIG. 2 is an illustration of a character printed at an optimal print speed for achieving a maximum dot density in a single pass of a printhead and print medium relative to one another.

The printhead 12 and printing system 10 may generate ink drops having volumes to provide some overlap of adjacent printed dots. For example selected volumes may generate ink dots on the print medium 18 that are about 106 μm to about 150 μm in diameter, with about 125 μm to about 130 μm being a target diameter with a 12 μm overlap between adjacent drops. With these selected volumes, the maximum frequency at which any one nozzle 20 may fire is about 7.2 kHz. When nozzles 20 in both columns are fired simultaneously at a print speed of 150 ft/min, a maximum horizontal and vertical dot density of 240 dpi×240 dpi is achieved as shown in FIG. 2. In operation, when the print medium 18 is moving in the direction designated by arrow 34 in FIG. 1, and the nozzles 20 in both columns 30 and 32 are ejecting ink simultaneously, the ink drops from the first column 30 generate ink dots that are vertically spaced apart 1/120", and horizontally spaced 1/240". Ink dots generated by nozzles 20 in the second column 32 fill in the gaps between the vertically spaced ink dots generated from the first column 30 of nozzles 20.

In reference to FIGS. 3 through 6 there are illustrated steps in the printing of the letter "B" shown in FIG. 2. The scale 36 represents the distance the print medium 18 has traveled relative to the printhead 12; and, the scale 38 represents the amount of time that has elapsed after printing dot columns on the medium 18. The distance the print medium 18 has traveled and the amount of time taken to travel the distance between ink drop ejections is determined as of the first column 1 of dots generated on the print medium 18. In this example, the print medium 18 is moving at a rate of speed of 150 ft/min, the printhead 12 may fire ink drops at a frequency of 7.2 kHz or every 139 microseconds (μs) and the dot spacing between dots measured from the centers of the dots is 106 μm.

Figure 3:
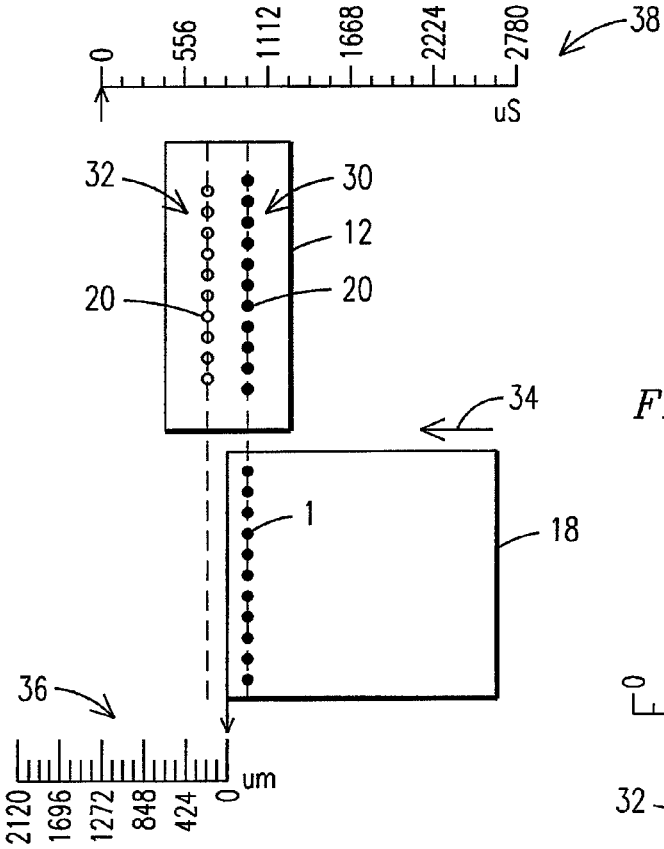
FIGS. 3 through 6 are schematic illustrations of a printhead printing the character shown in FIG. 2 on a print medium in successive steps. These illustrations also include scales relating to the advancement of the print medium and the timing of ink drop ejections.

As shown in FIG. 3, the first column 30 of nozzles 20 prints a dot column 1 at zero microseconds (μs) and the print medium 18 has traveled zero μm. In as much as the print medium 18 has not reached the second column 32 of nozzles 20, the second column 32 remains idle as the first column 30 ejects ink drops. The shading of the nozzles 20 represents nozzles ejecting ink drops; and, the white (non-shaded) nozzles represent nozzles 20 that are idle and ink drops are not ejected. In addition, the arrangement of nozzles shown in the drawings and described throughout provide a representation of the timing of firing the nozzles, and are not intended to represent the physical arrangement of the nozzles 20, except to the extent that the columns 30 and 32 are vertically offset relative on one another.

Figure 4:
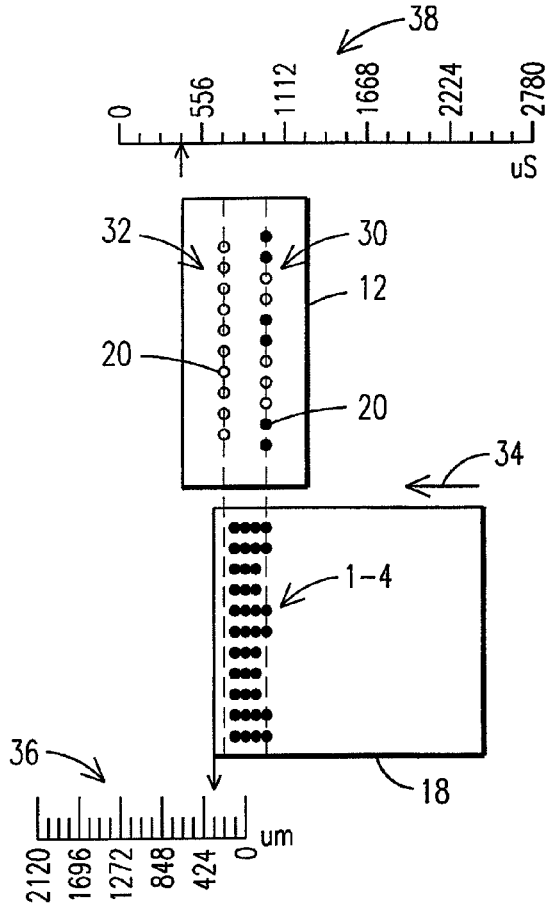
Figure 5:
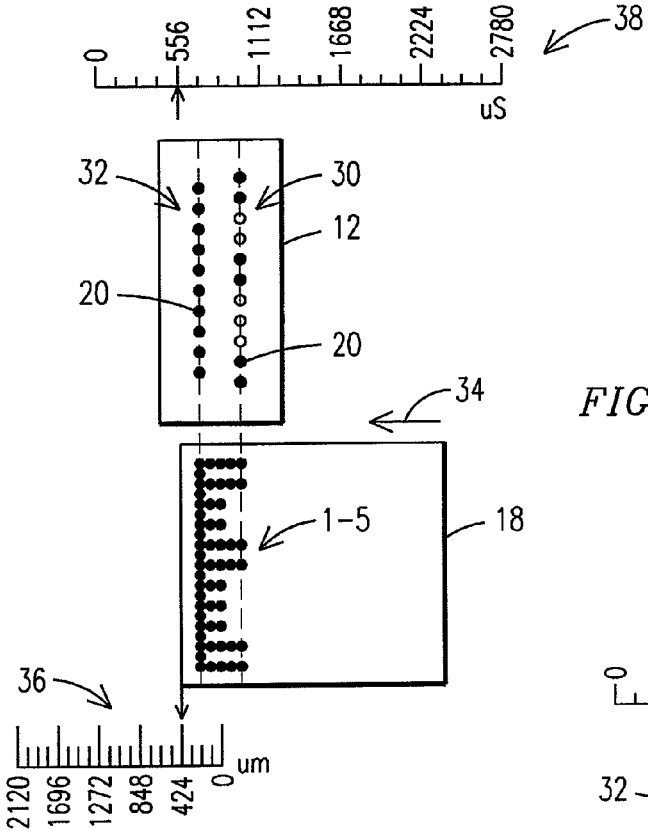
Figure 6:
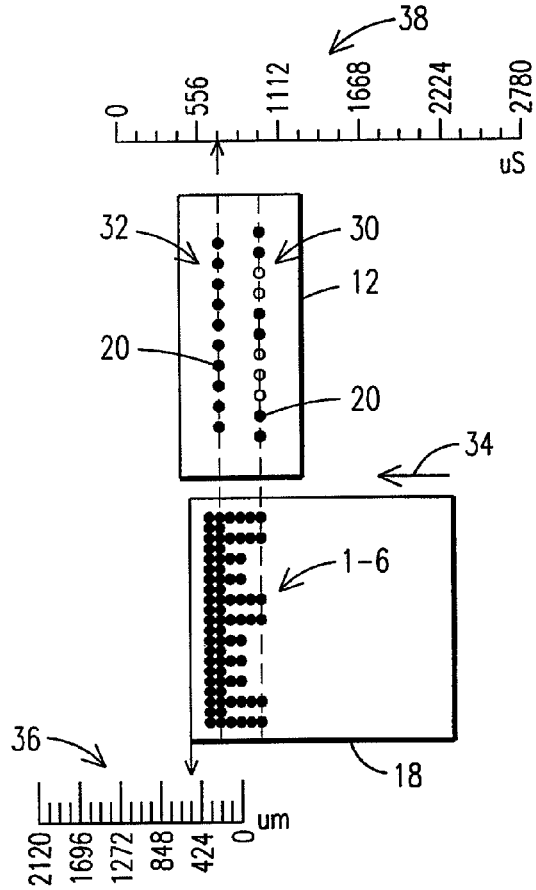

With respect to FIG. 4, four dot columns 1-4 have been generated by ejecting ink drops from the first column 30 of nozzles 20. Accordingly, 417 μs (3×139 μs) has elapsed since the first dot column 1 has been printed; and, the distance the print medium has traveled is 318 μm (3×106 μm). As shown in FIGS. 5 and 6, the second column 32 of nozzles 20 is fired simultaneously with the first column 30 of nozzles 20 filling in the gaps between dots that were generated from the first column 30. In this manner, the printing system 20 and printhead 12 are able to achieve a vertical 240 dpi drop density.

Figure 7:
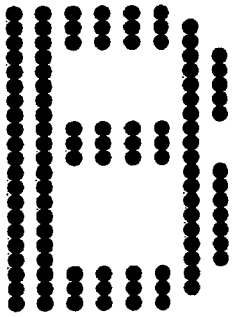
FIG. 7 is an illustration of a character printed at an increased print speed resulting in a horizontal dot density that is half that of the character in FIG. 2.

As explained above, the print speed associated with the above-described examples is 150 ft./min. So with a maximum ink ejection (firing) frequency (f) at a given print speed (x) the printing system 10 and printhead 12 are able to generate images on the print medium 18 having a maximum vertical and horizontal dot density. However, if the print speed is increased the horizontal resolution of the image may be compromised without increasing the ink ejection frequency. By increasing the print speed when the nozzles 20 in both columns 30 and 32 are firing simultaneously, the horizontal dot density matching the vertical dot density cannot be achieved. By way of example, if the print speed is doubled (2x) to 300 ft/min, and the columns 30 and 32 are ejecting ink drops simultaneously; the horizontal dot density is only one half, or 120 dpi. As shown in FIG. 7, an image generated at the increased print speed has empty vertical gaps between dot columns that are spaced apart 1/120" or about 212 μm wide.

Figure 8:
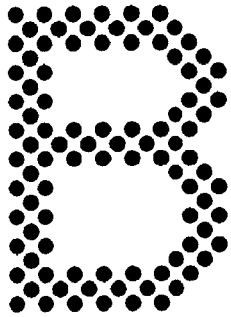
FIG. 8 is an illustration of a character including a checkerboard font, and representing a character that is printed in a single pass of a printhead and print medium relative to one another.
Figure 9:
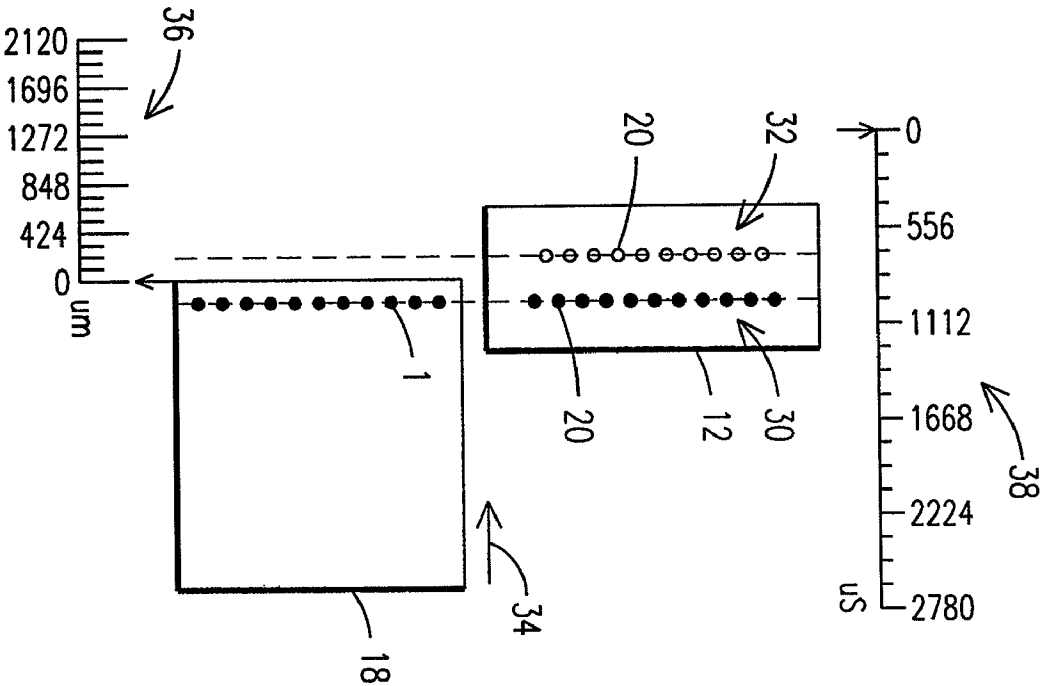
FIGS. 9 through 16 are schematic illustrations of a printhead printing the character shown in FIG. 8 on a print medium in successive steps and developing a checkerboard ink dot pattern. These drawings also include scales for relating the spacing of the ink dots and the timing of the ink ejections.

On the other hand, if the columns 30 and 32 of nozzles 20 can be fired in alternating succession as the print medium 18 and printhead 12 move relative to one another, a checkerboard pattern is created as shown in FIG. 8. In this checkerboard pattern, the empty vertical gaps of the image in FIG. 7 are occupied by ink dots, eliminating the striped appearance of the character. In addition, as there is no overlap of the dots, all of the ink printed contributes to a perceived optical density, making a darker, more legible character using the same amount of ink. In addition, the checkerboard pattern may be acceptable for certain operations at slower print speeds, even though the maximum dot density is possible thereby saving ink, if cost is more important than optimal print quality.

In order to alternate the ink ejection from columns 30 and 32 to create the checkerboard pattern at twice the print speed required to achieve the maximum dot density, the time (t) required to fire all the nozzles 20 on the printhead 12 in either column 30 or 32 must be less than ½ the time between the ejection of successive drops from the same nozzle 20. Considering the above described parameters, if the amount of time to fire a nozzle is 4 μs and by way of example, if the nozzles 20 in a single column are multiplexed using eleven groups of ten to twelve nozzles 20, then the amount of time (t) to fire all the nozzles 20 in either column 30 or 32 is 44 μs (11×4 μs). If the printhead 12 or nozzles 20 have a firing frequency of 7.2 kHz, then 139 μs will have elapsed between successive firing/ejection from a single nozzle 20. That is, the time spent moving from one dot column to a next dot column for either column 30 or 32 to eject ink drops at a horizontal density of 120 dpi is 139 μs at 300 ft/min; and, the time spent moving 1/240" is half of 139 μs or 69.5 μs. Therefore, while each column 30 and 32 of nozzles 20 is constrained to print consecutive dot columns on the print medium 18 that are spaced apart 1/120" at 300 ft/min., one of the nozzle columns 30 or 32 can print a dot column mid-way between vertical dot columns formed by the other nozzle column 30 or 32.

With respect to FIGS. 9 through 16, there is schematically illustrated the printhead 12 and nozzle columns 30 and 32 being fired in alternating succession to generate a checkerboard font. The operating parameters of the printing system 20 and printhead 12 are the same as described above with respect to printing the 240 dpi×240 dpi character at 150 ft/min., with the exception the print speed has been doubled to 300 ft/min. With respect to FIG. 9, nozzles 20 in the first column 30 have been fired creating a first dot column 1. As described above, scale 38 measures the amount of time elapsed between the firing of nozzles 20. The scale 36 represents the distance the print medium 18 has traveled between firings/ejections, or the distance between consecutive dot columns formed on the print medium 18. Both time and distance are measured beginning when the first dot column 1 is printed.

Figure 10:
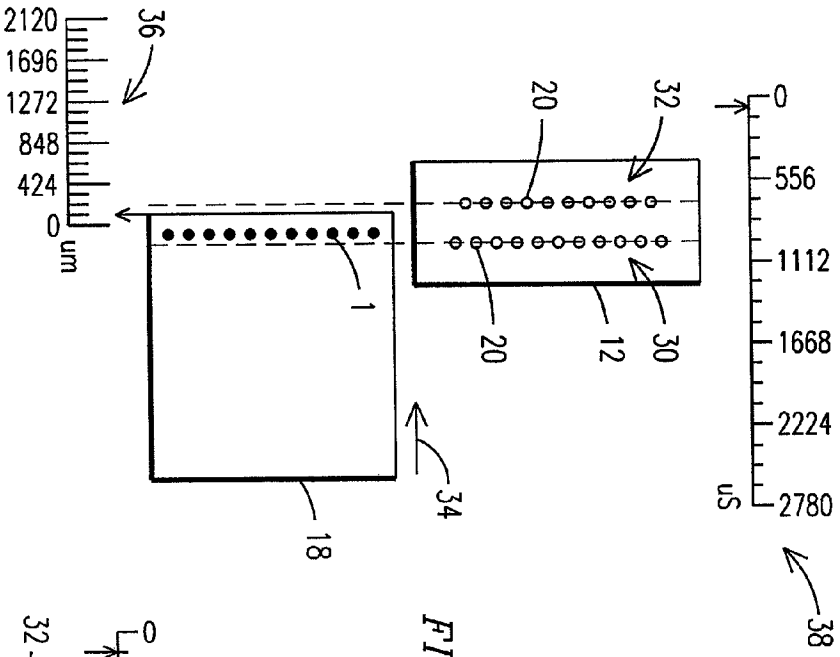

With respect to FIG. 10, the time elapsed since the first dot column 1 was printed has been only 69.5 μs so enough time has not elapsed for column 30 nozzles to fire again; therefore, column 30 remains idle. In addition, the second nozzle column 32 remains idle because the print medium 18 has not reached a position for ejecting ink drops there from. Note, if the print speed were ½ (150 ft/min) the current speed (300 ft/min), the first nozzle column 30 could fire at the position of the print medium 18 in FIG. 10.

Figure 11:
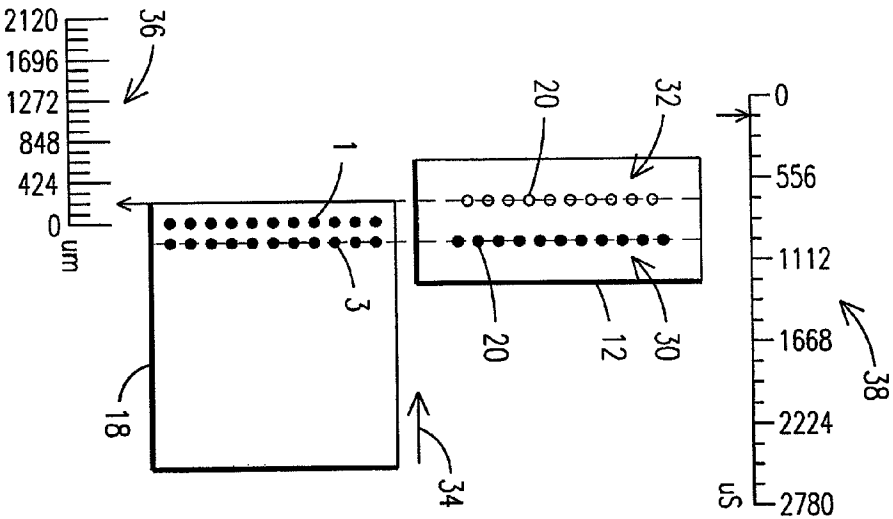
Figure 12:
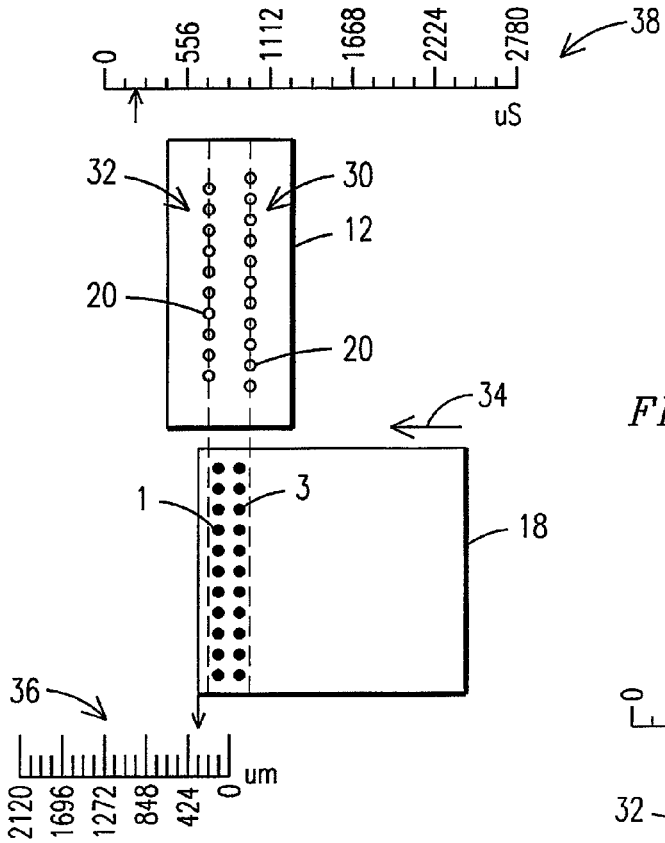
Figure 13:
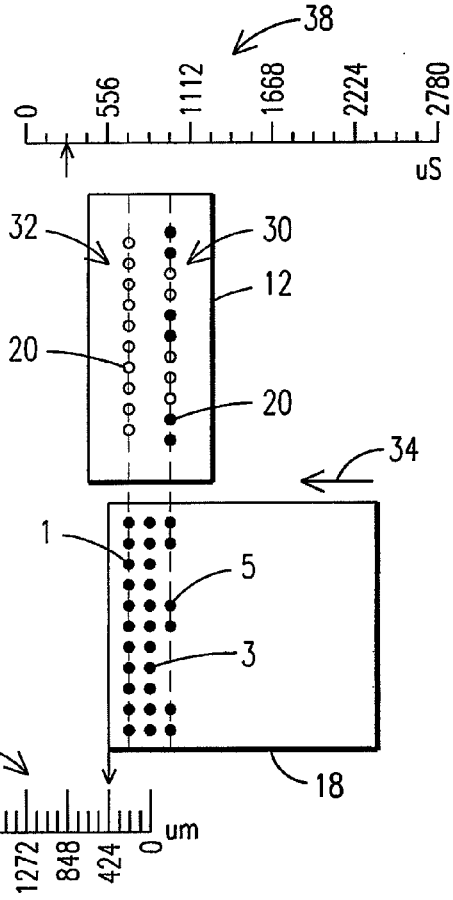
Figure 14:
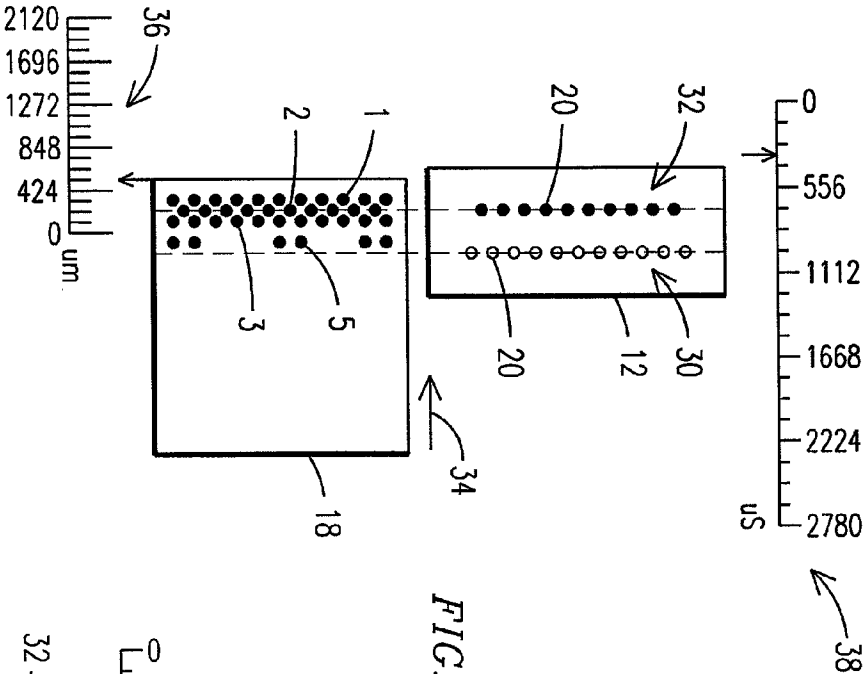

In FIGS. 11 through 13, the first column 30 of nozzles 20 is fired successively at the maximum firing frequency 7.2 kHz with the print medium or printhead 12 moving relative to one another at a rate of 300 ft/min. In FIG. 13, three dot columns 1, 3 and 5 have been generated from firing the first nozzle column 30; and, the ink dot columns 1, 3 and 5 are spaced apart 1/120" (about 212 μm). In FIG. 13, the print medium 18 is positioned relative to the second column 32 so that nozzles 20 could be fired simultaneously with column 30 nozzles 20; however, column 32 remains idle. Otherwise, nozzles in the second column 32 could not recharge in time to fire again to create the dots to fill the vertical gap between dot columns 1 and 3. Accordingly, in FIG. 14, nozzles 20 in the second nozzle column 32 are fired to print the dot column 2 disposed between the dot columns 1 and 3. The nozzles 20 in first nozzle column 30 remain idle in the step shown in FIG. 14.

Figure 15:
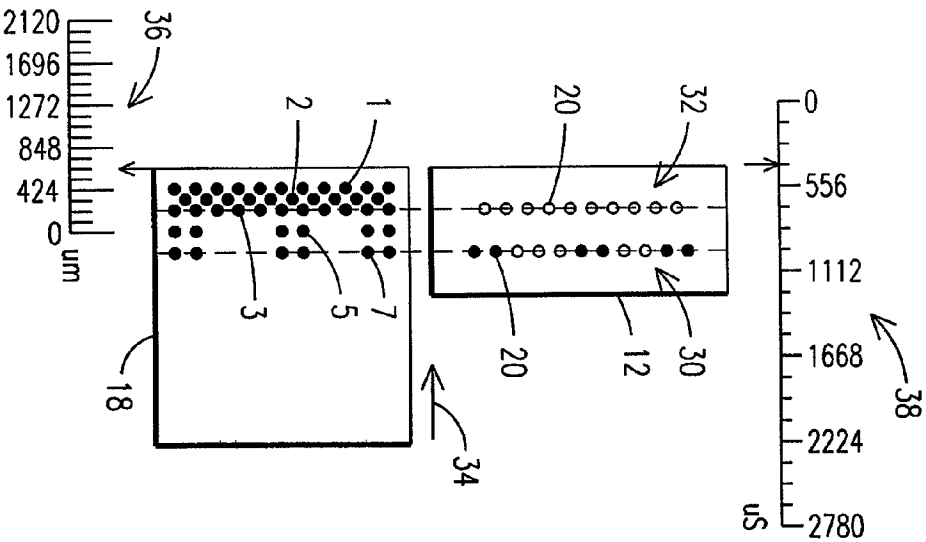
Figure 16:
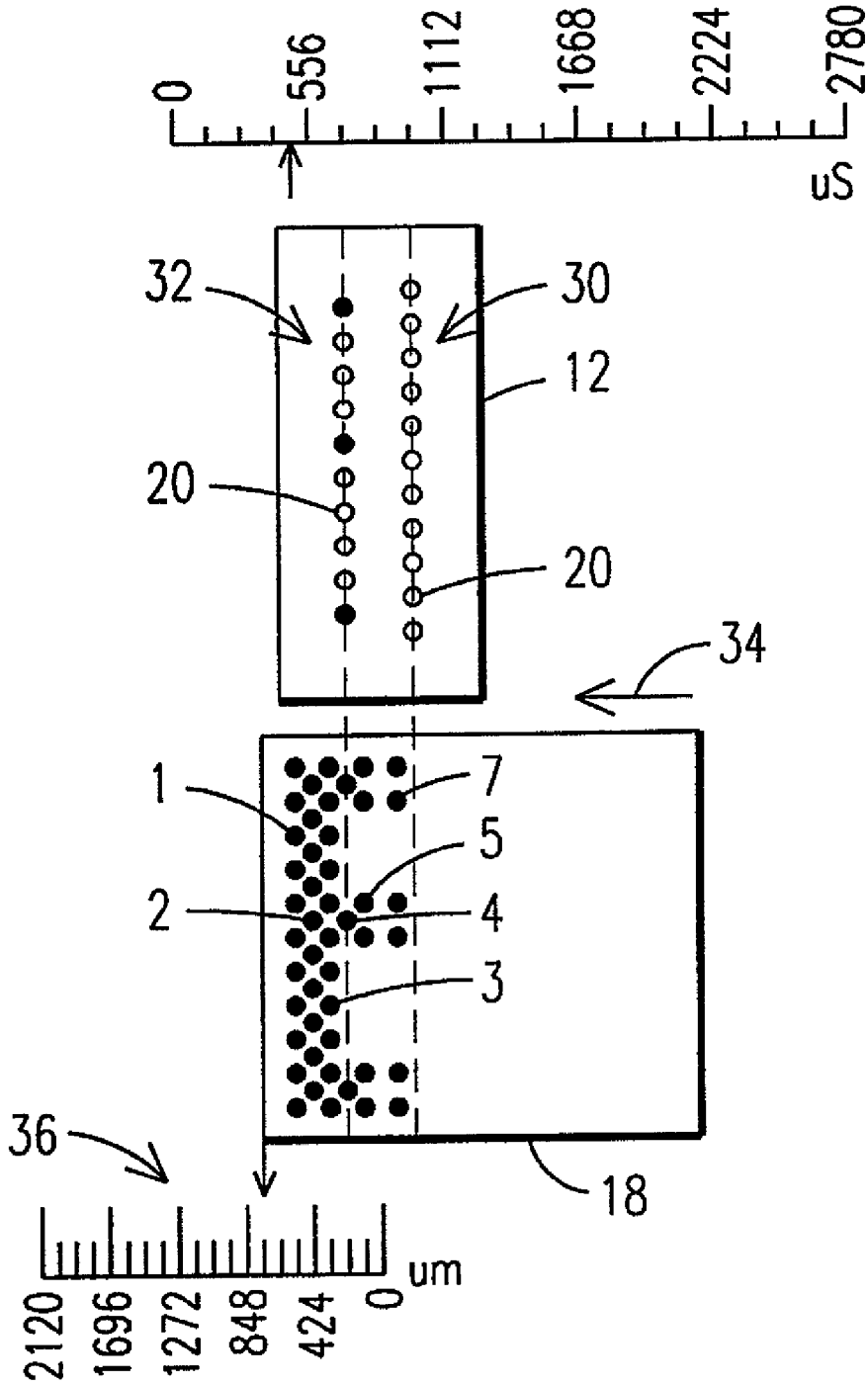

With respect to FIG. 15, the time elapsed since column 30 nozzles 20 were last fired is 139 μs, and nozzles 20 in first column 30 are recharged to fire again and print dot column 7; however, the time elapsed since second column 32 of nozzles 20 have fired has been only 69.5 μs, so nozzles 20 in the second column 32 remain idle. In FIG. 16, the nozzles 20 in the second column 32 are fired to print dot column 4 between the dot columns 3 and 5, and the first column 30 of nozzles 20 remains idle. The first and second columns 30 and 32 continue ejecting ink drops in alternating succession until all dots in the checkerboard font for a given character are completed in a single pass.

Patents, including U.S. Pat. Nos. 4,748,453 and 6,318,832 disclose printing systems that generate checkerboard pattern on a print medium; however, such systems are not generating an entire or complete image in a single pass of the printhead relative to the medium or vice versa. Indeed, in such systems the printhead makes multiple passes over the print medium generating a checkerboard pattern in each pass to overlap dots and cover unprinted areas on the medium. Moreover, such multi-pass processes are used for systems that demand high resolution images; therefore, multiple passes are used to eliminate jagged edges or gaps that may be acceptable for lower resolution demands. In contrast, in response to input print commands, embodiments of the present invention print a complete or final image or images having the checkerboard pattern in a single pass.

Figure 17:
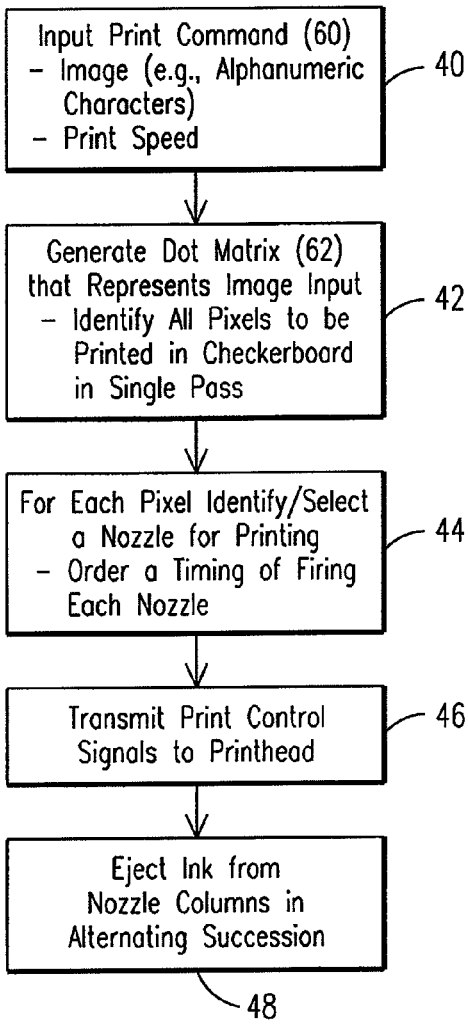
FIG. 17 is a flow chart describing a printing operation of an embodiment of the invention.

A flow chart is depicted in FIG. 17 and describes the operation of the printing system 10 in printing one or more images having a checkerboard font. More specifically, in block or step 40, a print command 60 is input into the controller 14. The print command 60 may include a signal relative to one or more images to be printed on the print medium 18 such as alphanumeric characters, and data relative to a print speed, which is the speed at which the printhead 12 or medium 18 are moving relative to one another. At steps/blocks 42 and 44, the controller 14 is configured to generate or identify a dot matrix 62 including a plurality of rows and columns of pixels associated with the input commands 60; and the controller identifies/selects all the pixels in the matrix 62 to be printed in a single pass, and the nozzles 20 associated with each pixel to be printed.

For example, the controller 14 may include a database 64 that includes a dot matrix for each image input or a plurality of images input into the controller 14. In as much as the checkerboard font may be used at any print speed that is equal to or less than 2x, the controller 14 may select a checkerboard font each time a print command is initiated regardless of the print speed. More specifically, the controller 14 may generate a dot matrix that includes a maximum dot density (i.e. 240 dpi×240 dpi) for an image that may be generated at a given print speed (x); however, the controller 14 may identify/select all the pixels necessary to print a checkerboard font, which will not include all the pixels for an image with a maximum dot density. For example, pixel columns in a dot matrix may be identified or distinguished as odd and even pixel columns and the pixel data within a column may be identified as even and odd pixel data. The controller 14 may be configured to select the odd pixel data when printing the odd pixel columns and the even pixel data when printing the even pixel column. That is, the controller 14 is configured to select every other pixel data in a column for printing and in an adjacent column selects the pixel data adjacent to the pixel data not selected in the previous column. Alternatively, the controller 14 may generate a dot matrix 62 that includes only those pixels necessary to complete the checkerboard font. In either case, in step 46 one or more print control signals 16 are transmitted to the printhead 12. With respect to step 48, in response to the print control signals 16, the nozzles 20 in first and second nozzle columns 30 and 32 are fired in alternating succession to print the desired image on the print medium 18 in a single pass.

Figure 18:
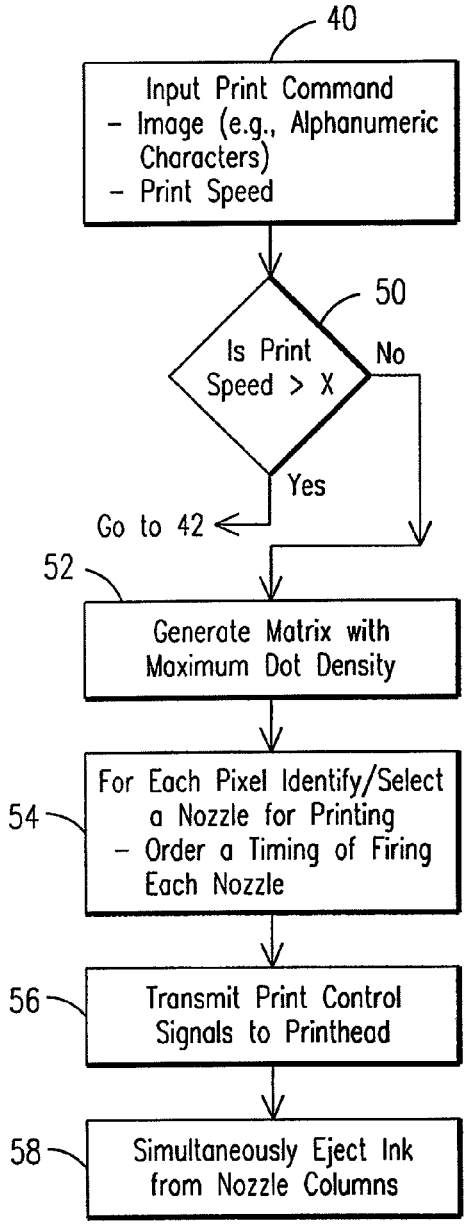
FIG. 18 is a flow chart showing alternative or additional steps in the operation of an embodiment of the invention.

In another embodiment, and with respect to FIG. 18, the controller 14 may be configured to have the option of printing an image at a maximum dot density or at a less than maximum dot density. More specifically, in step 50 the controller 14 determines whether an entered print speed is greater than a print speed x, which is the print speed at which the printing system 10 and printhead 12 can achieve a maximum dot density. If the entered print speed is not greater than x, images having the maximum dot density are printed. As represented in step 52, a dot matrix having the maximum dot density is generated, and in step 54 the nozzles for each pixel is identified along with a timing sequence for firing the nozzles 20. In step 56, the print control signal is transmitted and in step 58 the columns 30 and 32 of nozzles 20 are fired simultaneously. If the print speed is greater than x, then the checkerboard font is selected. However, the checkerboard font may be selected for any print speed that is less than or greater than print speed x up to about twice (2x) the rate of speed of the print speed x.

In this manner, a user of the disclosed novel inkjet printing system 10 may choose to select the checkerboard font to optimize a print quality at scan or prints speeds that are higher than an optimal print speed for a given maximum firing frequency. At such print speeds embodiments of the invention optimize the amount of space that may be filled by ink dot columns, and avoids printing stripes that may compromise the print quality. In addition, the amount of ink may be conserved if one accepts a lower resolution image than generated when printing at the optimal speed associated with the maximum firing frequency.

Embodiments described above may be implemented on a suitable computer system, controller, data, or generally a computer readable medium. For example, the steps of the methods described above may correspond to computer instructions, logic, software code, or other computer modules disposed on the computer readable medium, e.g., floppy disc, hard drive, ASIC, remote storage, optical disc, or the like. The computer-implemented methods and/or computer code may be programmed into an electronic control unit of the printing system, While the preferred embodiments of the present invention have been shown and described herein, it will be obvious that such embodiments are provided by way of example only and not of limitation. Numerous variations, changes and substitutions will occur to those skilled in the art without departing from the teaching of the present invention. For example, while specific examples of ink drop density, firing frequencies, ink drop diameter, the disclosed and claimed invention is not so limited, but may encompass other such printing parameters that allow the printhead to eject ink drops to form dot columns in alternating succession to print an image in a single pass. Accordingly, it is intended that the invention be interpreted within the full spirit and scope of the appended claims.

What is claimed is:

1. An inkjet printing system for optimizing print quality at print speeds that are greater than a given print speed associated with a maximum frequency for ejecting ink drops from a printhead, comprising:

a printhead in fluid communication with an ink source;

at least a first column of a plurality of nozzles and a second column of a plurality of nozzles on the printhead for ejecting ink onto a print medium in droplet form and wherein each of the nozzles in the first column are spaced apart from one another, the nozzles in the second column are spaced apart from one another and each of the nozzles in the first column are vertically or horizontally offset relative to the nozzles in the second column and do not share a horizontal axis or vertical axis with any of the nozzles in the second column; and, at least one controller in electrical communication with the printhead that is configured to generate print control signals relative to the formation of one or more images on the print medium wherein ink from the first column of nozzles is ejected in alternating succession with the ejection of ink from the second column of nozzles wherein the one or more images are printed on the print medium in a single pass of the print medium and the printhead relative to one another.

2. The inkjet printing system of claim 1, wherein the printhead includes a plurality of ejection chambers and each chamber is associated with a nozzle and includes a resistive heater for firing ink drops responsive to the print control signals.

3. The inkjet printing system of claim 1, wherein the print medium moves relative to the printhead, which remains stationary.

4. The inkjet printing system of claim 1, wherein an image is generated having a horizontal dot density that matches a vertical dot density when the print medium and printhead move relative to one another at a print speed of x and the ink is ejected from first and second columns of nozzles simultaneously, and an image is generated in which the horizontal and vertical dot densities match when the print medium and printhead move relative to one another at a print speed of up to about 2x and the first and second columns of nozzle eject ink in alternating succession.

5. The inkjet printing system of claim 1, wherein responsive to a print command the controller identifies a dot matrix comprising a plurality of rows and columns of pixels including all the pixels in the dot matrix selected to represent one or more images to be printed on the print medium in a single pass of the print medium and printhead relative to one another, and the controller associates each selected pixel with a nozzle on the printhead from which one or more ink drops will be ejected to form the one or more images on the print medium in a single pass of the print medium and printhead relative to one another.

6. The inkjet printing system of claim 1, wherein the controller transmits a first set of print control signals to the printhead when the print medium is moving at a rate of speed of x so nozzles in both columns are fired simultaneously to produce an image having a horizontal dot density that matches a vertical dot density, and transmits a second set of print control signals when the print medium is moving at a rate of speed of about Nx, wherein N is a number less than, equal to or greater than 1 up to the number 2, such that ink is ejected from the nozzles in the first and second columns in alternating succession forming a plurality of ink drop columns on the print medium.

7. The inkjet printing system of claim 6, wherein each nozzle on the printhead, in response to either set of print control signals, is able to eject ink drops at a maximum frequency of f, the time between successive ejection of ink drops from the same nozzle is 1/f and the amount of time required to fire all the nozzles on the printhead or all of the nozzles in either column is less than half of 1/f.

8. The inkjet print system of claim 1, wherein the controller, in response to a print command input for printing the one or more images on the print medium, identifies a dot matrix that is indicative of the one or more images and the dot matrix includes a plurality of pixel columns and pixel rows and pixel data in each of the pixel rows and columns, and wherein for a print speed of x the controller selects all pixels in each column for printing to generate an image wherein x is a maximum print speed at which a horizontal dot density matches a vertical dot density, and at a print speed of greater than x the controller selects every other pixel data in a first column for printing and for an adjacent second column selects the pixel data adjacent to the pixel data not selected in the first column.

9. A thermal inkjet printing system, comprising:

a print cartridge having a printhead in fluid communication with an ink source for printing wherein the printhead remains stationary on the printing system as a print medium moves relative to the printhead for printing an image on the print medium;

wherein the printhead further comprises a first column of a plurality of nozzles and a second column of a plurality of nozzles on the printhead for ejecting ink onto a print medium in droplet form and wherein each of the nozzles in the first column are spaced apart from one another, the nozzles in the second column are spaced apart from one another and each of the nozzles in the first column do not share either a vertical axis or horizontal axis with any of the nozzles in the second column;

wherein the printhead is able to eject ink drops at a maximum frequency of f which produces a horizontal dot density which matches a vertical dot density when nozzles in the first and second columns are fired simultaneously and the print medium and printhead are moving relative to one another up to a maximum print speed of x; and, a controller, in electrical communication with the printhead and in response to print command input relative to the image to be printed in a single pass of the print medium moving relative to printhead, transmits a set of print control signals when the print medium is moving at a rate of speed of up to about 2x such that ink is ejected from the nozzles in the first and second columns in alternating succession forming a plurality of ink drop columns on the print medium and the image is printed on the print medium in a single pass of the print medium moving relative to the print cartridge, and the first column of nozzles form ink drop columns horizontally spaced from one another on the print medium, and the second column of nozzles form an ink drop column between the successive ink drop columns formed by the first column of nozzles.

10. The thermal inkjet printing system of claim 9, wherein each nozzle on the printhead, in response to the print control signals, is able to eject ink drops at a maximum frequency of f, the time between successive ejection of ink drops from the same nozzle is 1/f and the amount of time required to fire all the nozzles on the printhead or all of the nozzles in either column is less than half of 1/f.

11. The thermal inkjet printing system of claim 9, wherein the printhead includes a plurality of ejection chambers and each chamber is associated with a nozzle and includes a resistive heater for firing ink drops responsive to the print control signals.

12. The thermal inkjet printing system of claim 9, wherein the print medium moves relative to the printhead, which remains stationary.

13. The inkjet printing system of claim 9, wherein responsive to print command input the controller identifies a dot matrix comprising a plurality of rows and columns of pixels including all the pixels in the dot matrix selected to represent the image to be printed on the print medium in a single pass of the print medium relative to the printhead, and each selected pixel is associated with a nozzle on the printhead from which one or more ink drops will be ejected to form the image on the print medium in a single pass of the print medium relative to the printhead.

14. The inkjet printing system of claim 9, wherein responsive to the print command input the controller identifies a dot matrix that is indicative of the image to be printed and the dot matrix includes a plurality of pixel columns and pixel rows and pixel data in each of the pixel rows and columns for printing the image on the print medium at a maximum horizontal dot density when nozzles in both columns are fired simultaneously and the print medium and printhead are moving relative to one another at print speed x, and at a selected print speed of greater than x the controller selects every other pixel data in a first column for printing and for an adjacent second column selects the pixel data adjacent to the pixel data not selected in the first column.

15. The inkjet printing system of claim 9, wherein the controller transmits a second set of print control signals to the printhead when the print medium is moving at the print speed of x so nozzles in both columns are fired simultaneously to produce an image having a maximum horizontal and vertical dot density.

16. The inkjet print system of claim 15, wherein for a selected print speed of x the controller selects all pixels in each column for printing to generate an image at a maximum horizontal dot density wherein x is a maximum print speed at which the maximum dot density can be achieved.

17. A method for generating a printed image in an inkjet print system, comprising:

using a print cartridge having a printhead in fluid communication with an ink source and the printhead having at least a first column of a plurality of nozzles and a second column of a plurality of nozzles on the printhead for ejecting ink onto a print medium in droplet form and wherein each of the nozzles in the first column are spaced apart from one another and the nozzles in the second column are spaced apart from one another, and each of the nozzles in the first column are vertically offset relative to the nozzles in the second column and do not share a horizontal axis with any of nozzles in the second column, and wherein each of the nozzles has a maximum frequency, f, at which a nozzle may eject successive ink drops having an optimal ink volume, wherein firing all nozzles in either the first or second column takes less than half of 1/f;

using a controller, in electrical communication, for inputting a print command for a desired image to be printed, and data relative to a print speed at which the print medium and printhead shall move relative to one another for performing a printing operation;

transmitting print control signals from the controller to the printhead, wherein the print control signals are indicative of the image data and timing of activating the nozzles for performing the print control operation;

in response to the print control signals, moving the print medium relative to the printhead at a speed of x, less than x or greater than x, wherein x is a maximum speed at which the maximum frequency allows the printhead to print at a maximum horizontal dot density that is equal to the vertical dot density for printing an image on the print medium in a single pass of the print medium relative to the printhead; and, in response to the print control signals, ejecting ink from the first column of nozzles in alternating succession with the ejection of ink from the second column of nozzles for printing the image on the print medium, the image comprising a matrix of printed rows of ink dots and printed columns of ink dots and each row of the ink dots having a horizontal dot density that is equal to a vertical dot density associated with each ink dot column.

18. The method of claim 17, further comprising transmitting a first set of print control signals when the print medium is moving at a print speed x or slower to simultaneously eject ink from the nozzles in the first and second nozzle columns to achieve a vertical and horizontal maximum dot density associated with the image, and transmitting a second set of print control signals when a selected print speed is greater than x to fire the nozzles in the first and second columns in alternating succession.

19. The method of claim 17, wherein in response to the print command input, identifying a dot matrix comprising a plurality of rows and columns of pixels including all the pixels in the dot matrix selected to represent the image to be printed on the print medium in a single pass of the print medium relative to the printhead, and associating selected pixel with a nozzle on the printhead from which one or more ink drops will be ejected to form the image on the print medium in a single pass of the print medium relative to the printhead.

20. The method of claim 17, wherein responsive to the print command input, identifying a dot matrix that is indicative of the image to be printed and the dot matrix includes a plurality of pixel columns and pixel rows and pixel data in each of the pixel rows and columns for printing the image on the print medium at a maximum horizontal dot density when nozzles in both columns are fired simultaneously and the print medium and printhead are moving relative to one another at print speed x, and at a selected print speed of greater than x selecting every other pixel data in a first column for printing and for an adjacent second column selects the pixel data adjacent to the pixel data not selected in the first column.

* * * * *

UNITED STATES PATENT AND TRADEMARK OFFICE

CERTIFICATE OF CORRECTION

PATENT NO. : 8,201,909 B2
APPLICATION NO. : 12/629995
DATED : June 19, 2012
INVENTOR(S) : Mike Barbour, Mark R. Thackray and Charles W. Gilson It is certified that error appears in the above-identified patent and that said Letters Patent is hereby corrected as shown below:

Column 9, claim 1, line 37, delete “are” and insert --is--;
line 40, delete “are” and insert --is--; and
line 42, delete “do” and insert --does--.

Column 10, claim 8, line 36, delete “print” and insert --printing--.

Column 10, claim 9, line 59, delete “are” and insert --is--;
line 61, delete “do” and insert --does--; and
column 11, line 18, delete “form” and insert --forms--.

Column 11, claim 13, line 36, after “The” insert --thermal--.

Column 11, claim 14, line 46, after “The” insert --thermal--.

Column 11, claim 15, line 59, after “The” insert --thermal--.

Column 11, claim 16, line 65, after “The” insert --thermal--; and delete “print” and insert --printing--.

Column 12, claim 17, line 10, delete “are” and insert --is--;
line 13, delete “are” and insert --is--; and
line 14, delete “do” and insert --does--.

Signed and Sealed this
Eighteenth Day of September, 2012

David J. Kappos

David J. Kappos
*Director of the United States Patent and Trademark Office*